US006352156B1

(12) United States Patent
Ueno

(10) Patent No.: US 6,352,156 B1
(45) Date of Patent: Mar. 5, 2002

(54) SEALER

(75) Inventor: Hideyuki Ueno, Kanagawa (JP)

(73) Assignee: Kotec's Co., Ltd., Tokyo (JP)

( * ) Notice: Subject to any disclaimer, the term of this patent is extended or adjusted under 35 U.S.C. 154(b) by 0 days.

(21) Appl. No.: 09/542,336

(22) Filed: Apr. 5, 2000

(30) Foreign Application Priority Data

Apr. 5, 1999 (JP) ..... 11-097859

(51) Int. Cl.[7] ..... B65D 85/24

(52) U.S. Cl. ..... 206/338; 206/343; 24/16 PB; 24/16 R; 24/17 AP

(58) Field of Search ..... 24/16 PB, 17 R, 24/17 AP, 704.1, 30.5 P, 704.2, 16 R; 206/338, 343, 345, 346; 292/319–321; 140/93 A, 93 Z

(56) References Cited

U.S. PATENT DOCUMENTS 5,501,002 A * 3/1996 Fukami ..... 29/811.2
5,799,375 A * 9/1998 Fukami ..... 24/16 PB
5,908,110 A * 6/1999 Hirai ..... 206/345
6,101,683 A * 8/2000 Deschenes et al. ..... 24/16 PB

* cited by examiner

*Primary Examiner*—Anthony Knight
*Assistant Examiner*—Ruth A. Rodriguez
(74) *Attorney, Agent, or Firm*—Young & Thompson

(57) ABSTRACT

An array if sealers for hangtags and the like includes plural parallel sealers on two connecting pieces. Each of the sealers includes a filament, an inserting head at one of the filament, and a socket at another end of the filament. Each sealer is attached to adjacent sealers with latching pieces that are arrayed on one or both sides of the connecting piece that is adjacent to the inserting heas. The latching pieces hold the sealers in proper alignment for a dispensing gun.

9 Claims, 6 Drawing Sheets

SEALER

BACKGROUND OF THE INVENTION

1. Field of the Invention

The present invention relates to a sealer for attaching and sealing tags such as blank labels, price tags, material description, instruction manual, etc. to clothes, shoes, bags, and other products, and more particularly to a sealer that can smoothly attached tags when it is set to a special-purpose tag attaching tool for attaching tags as specified above.

2. Description of the Related Art

In general, a sealer as shown in FIG. 10 has been used for banding together clothes, women's boots, sandals, shoes, etc. or for attaching blank labels, price tags, etc.

In FIG. 10, the sealer comprises a filament section 5 for forming a loop by passing a tag, an inserting head section 6 equipped on one end thereof, and a socket section 8 equipped with an insertion hole 7 equipped at the other end of the filament section 5 and for allowing the relevant inserting head section 6 to pass. And a plurality of sealers 4 are temporarily fixed to two bars 11 in parallel to one another in such a manner to enable easy removal.

The example of FIG. 10 is integrally molded preferably with synthetic resin, etc., and in particular, the filament section 5 is elongated to exhibit extremely strong resistance against pulling. When the inserting head section 6 penetrates the narrow part of the socket section 8, a latching piece 9, which is a hook mounted near the insertion hole 7, opens, and this causes the neck part 6*a* of the inserting head section 6 is inversibly fixed in the socket section 8, and a loop-form label attaching condition is completed, and sealing is achieved.

Conventionally, these sealers are loaded in a special-purpose tag attaching tool (gun), and it is used by operating a lever 18*a* so as to set the inserting head into the socket section not only for banding together boots, sandals, and shoes but also primarily for fixing blank labels and tags T that carry the instruction manual of a product.

However, the conventional sealer described above has a problem in that some of the inserting head sections of sealers inherently arranged in parallel to one another turn to different directions as shown in FIG. 10, respectively, depending on the storage condition, and are not loaded to the driving pins of the gun in a correct direction and jamming condition occurs when the sealer is set to the special-purpose device (gun) that can continuously seal by pulling the lever. In addition, the inserting head sections are not properly fitted to the socket section, causing failure of the device.

Accordingly, it is an object of the present invention to provide a sealer whose inserting head sections are able to constantly maintain the correct direction and which can improve the operability when the sealer is set to the tag attaching tool.

SUMMARY OF THE INVENTION

In order to solve the above problems, the present invention basically adopts a configuration described as follows. That is, the present invention relates to a sealer comprising a filament section with flexibility, an inserting head section with a proper engaging section located at one end of the filament section, and a socket section located at the other end of the filament section and equipped with a hole for irreversibly passing the inserting head section, wherein a plurality of said sealers having the filament sections arranged adjacent to and in parallel to one another, and at the same time, a plurality of the inserting head sections or their neighboring sections and a plurality of said socket sections or their neighboring sections arranged adjacent to one another connected, respectively, to connecting bar sections individually provided, and the vicinity of the inserting head sections further connected to one another with the latching pieces.

Because the sealer according to the present invention first respective portions of the sealers located in the vicinity of the inserting head sections are connected to each other with separate latching pieces, even when improper external force is applied to the sealers during transportation or storage, the directions of the inserting head section are not misaligned, and the operability when the sealer is set to the tag attaching tool can be improved.

DETAILED DESCRIPTION OF THE PREFERRED EMBODIMENT

Figure 1:
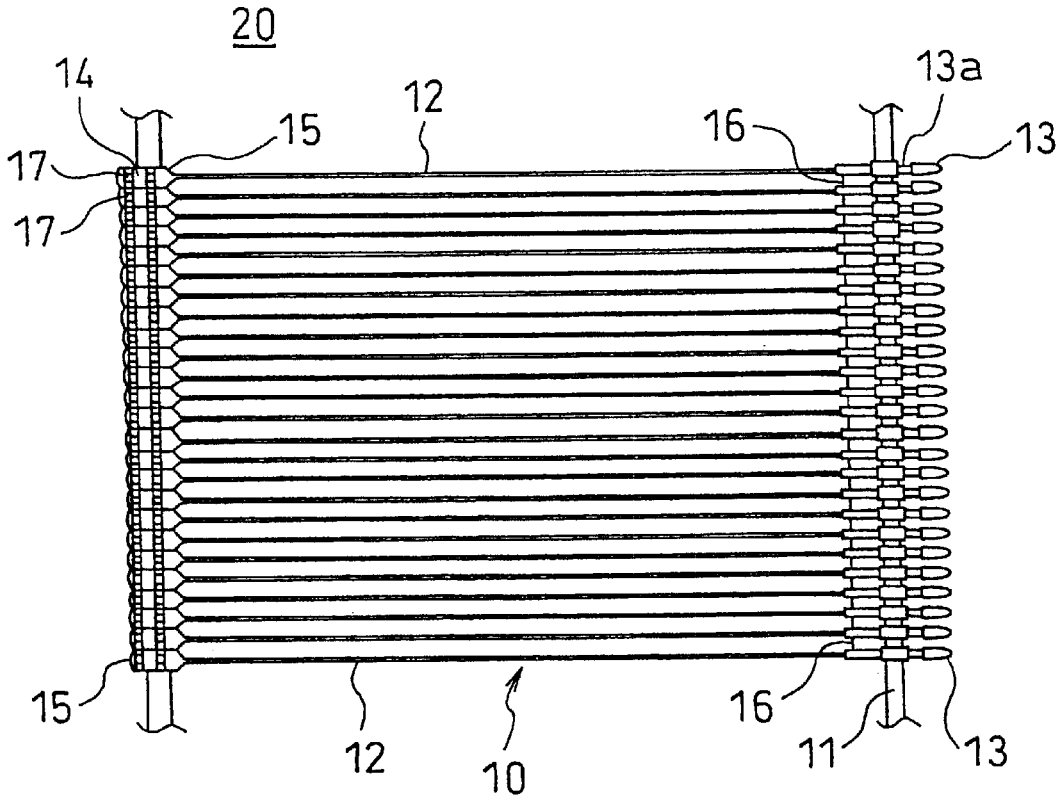
FIG. 1 is a front view showing the configuration of one specific example of the sealer related to the present invention.
Figure 2:
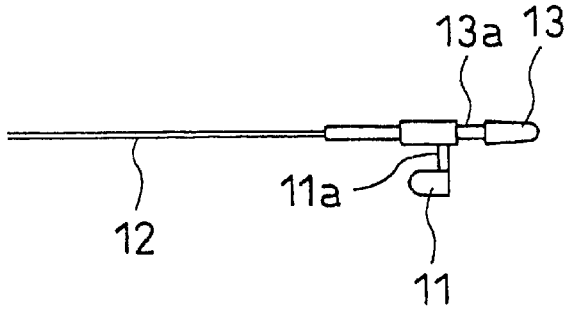
FIG. 2 is an enlarged plan view showing an essential part of the sealer.

Referring now to drawings, description will be made in detail on the configuration of one specific example of the sealer related to the present invention. That is, FIG. 1 is a front view showing the configuration of one specific example of the sealer related to the present invention and FIG. 2 is an enlarged plan view showing the essential part of the sealer. Now, the sealer 20 according to the present invention comprises a filament section 12 with flexibility, an inserting head section 13 with a proper engaging section 13a located at one end of the filament section 12, and a socket section 15 located at the other end of the filament section 12 and equipped with a hole 14 for irreversibly passing the inserting head section 13, a plurality of said sealers 10 having the filament sections 12 arranged adjacent to and in parallel to one another, and at the same time, a plurality of the inserting head sections 13 or their neighboring sections and a plurality of said socket sections 15 or their neighboring sections arranged adjacent to one another being connected, respectively, to connecting bar sections 11 individually provided, and a portion located in the vicinity of the inserting head sections of each of the filament portion further connected to one another with the latching pieces 16.

The sealer 20 according to the present invention is integrally molded generally with synthetic resin such as nylon, polypropylene, polyester, etc. as in the case of conventional sealers.

Referring now to FIG. 1, the first specific example of the sealer 20 related to the present invention will be further described. First of all, the basic configuration of the sealer 20 related to the present invention is nearly same as that of the conventional sealer, and further at the socket section 15, an insertion hole 14 for irreversibly passing the inserting head section 13 is equipped. In the present invention, the cross-sectional profile of the filament section 12 may be any of circle, flattened shape, or rectangle.

To the insertion hole 14 of the socket section 15, an engaging section 17 to which the engaging section 13*a* formed to have a diameter reduced stepwise on part of the inserting head section 13 is able to be latched is provided. The engaging section 17 is deformably formed protrudably in the insertion hole 14.

Figure 3:
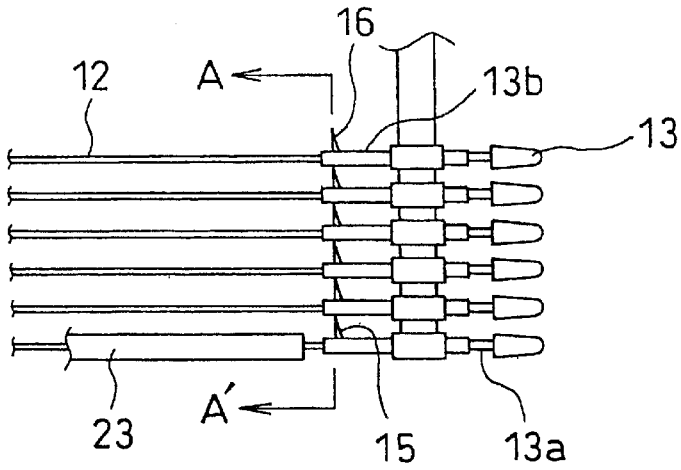
FIG. 3 is an enlarged side view of the sealer.
Figure 4:
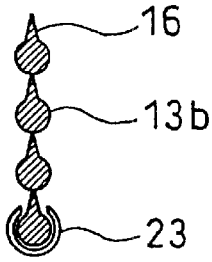
FIG. 4 is a cross sectional view taken on line A—A of the sealer shown in FIG. 3.

The sealer 10 in the present embodiment has latching pieces 16 for connecting the base end parts 13*b* of adjacent inserting head sections 13 each other as shown in FIG. 3 and 4 are disposed on the filament section 12 side. Consequently, since the inserting head section 13 is connected at 2 places vertically to the latching piece 16 and the bar 11, the direction of the head end is not deviated.

In addition, the portion of the latching piece 16 connected to part of other inserting head section 13 is formed slenderly for easy cutting. In addition, the sealers 10 are temporarily fixed to the bar 11, respectively, in parallel. Consequently, only pulling the lever 18*a* after loading the sealers to the tag attaching tool can easily separate the sealers one by one and can attach labels, etc. to the sealers.

Figure 6:
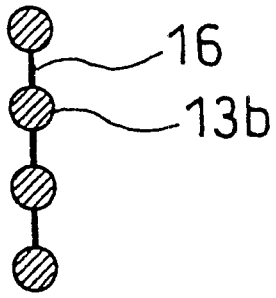
FIG. 6 is an enlarged cross-sectional view showing an essential part of another embodiment of the sealer.

As shown in FIG. 6 as the other embodiment, the latching piece 16 that connect adjacent inserting head sections 13 may be formed in the form of a thin string. The latching piece 16 is only required to hold the direction of the inserting head section 13, and does not need the strength exceeding that requirement.

Figure 7:
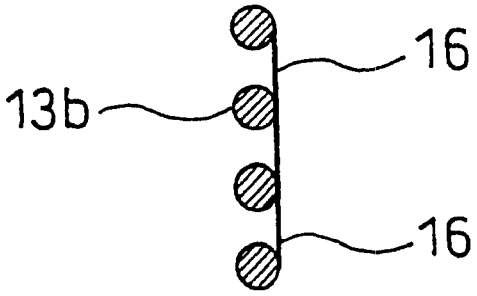
FIG. 7 is an enlarged cross-sectional view showing an essential part of still another embodiment of the sealer.

FIG. 7 is an enlarged cross-sectional view showing an essential part of still another embodiment of the sealer. In the drawing, the latching piece 16 is formed in such a manner to connect the cross-sectional-side edge of the inserting head section 13. Even when it is formed in this way, the direction of the inserting head section 13 is able to hold constantly.

Figure 8:
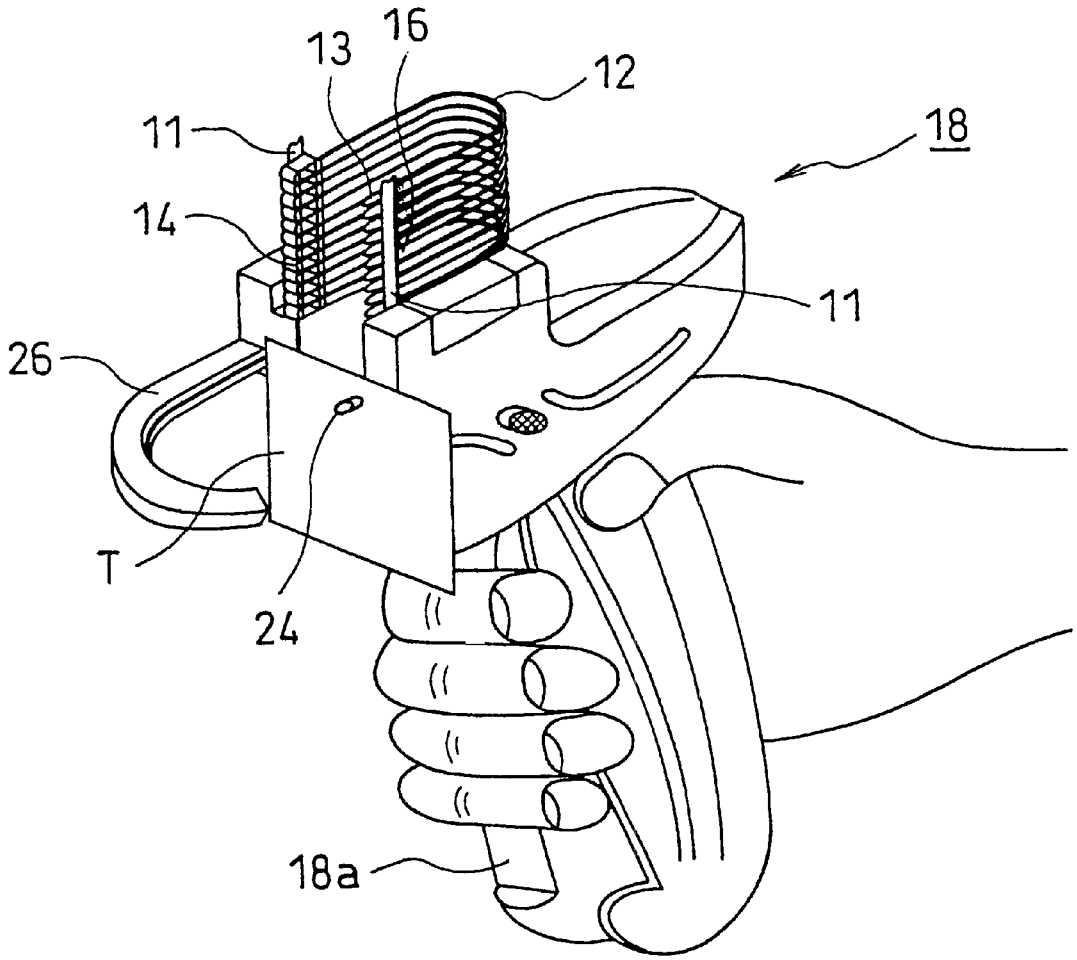
FIG. 8 is a perspective view showing the condition in which the sealer according to the present invention is set to the special-purpose tag attaching tool (gun)
Figure 9:
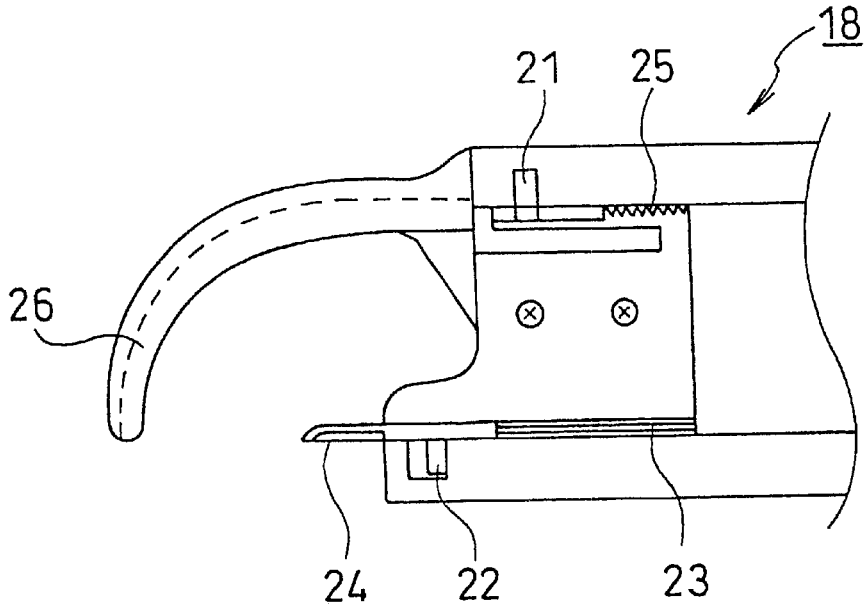
FIG. 9 is a plan view showing an essential part of the tag attaching tool for using the sealer according to the present invention.
Figure 10:
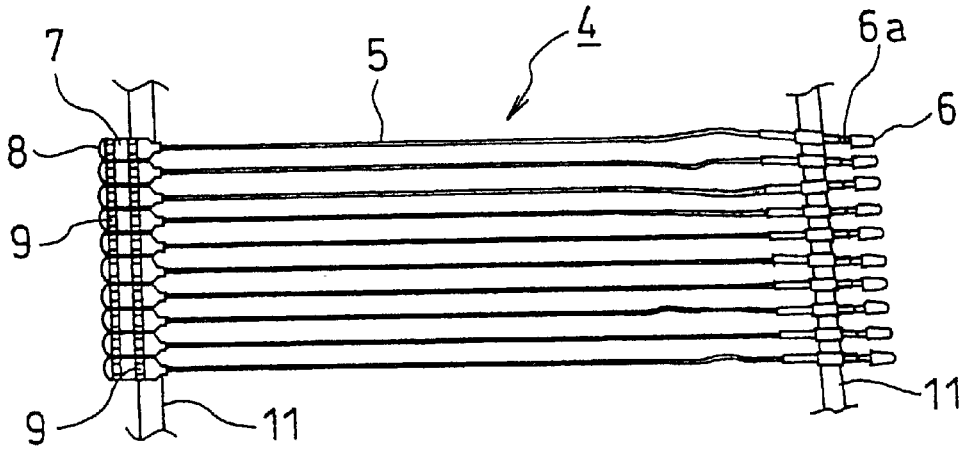
Fig. 10 PRIOR ART
FIG. 10 is a plan view showing an essential part of one embodiment of the conventional sealer.

FIG. 8 is a perspective view showing the condition in which the sealer according to the present invention is set to the special-purpose tag attaching tool (gun) and FIG. 9 is a plan view showing an essential part of the tag attaching tool for using the sealer according to the present invention. Now, to the tag attaching tool 18, longitudinal grooves 21, 22 are formed on the right and the left for inserting the connecting bars 11 of the sealer 20. To the longitudinal groove 21, for example, the connecting bar 11 for connecting the socket section 15 of the sealer 20 is inserted, and to the longitudinal groove 22, the connecting bar 11 for connecting the inserting head section 13 is inserted. In addition, to the tag attaching tool 18, tag attaching pins 23 driven by operating the lever 18*a* illustrated are disposed on the side of the longitudinal groove 22, and separates the inserting head section 13 from the connecting section 11*a* of the connecting bar 11 and pushes out the sealer one by one forwards along the cylindrical guide needle 24.

On the other hand, the socket section 15 with the bar 11 for connecting this to the longitudinal groove 21 inserted is separated from the connecting section of the connecting bar 11 by the press-out belt 25, and pushed out one by one forward along the curved socket section guide 26. The socket section 15 pushed out along the socket section guide 26 turns the direction 90° and fits to the inserting head section 13 pushed out by the tag attaching pin 23 at the head end portion in the insertion hole 14.

The socket section guide 26 changes the direction about 90° with the inside deformed cylindrically so that the press-out belt 25 is able to advance while being bent. And it is configured in such a manner that the timing of the head end of the press-out belt 25 reaches the top end of the socket section guide 26 coincides with the timing of the tag-attaching pin 23 reaching the top end of the socket section guide 26. In this way, the sealer 20 is able to attach labels successively and continuously to products, etc.

For another embodiment, the latching piece 16 connecting sealers 10 one another is formed in the form of a cone and the thin part of the head end is connected to the neighboring inserting head section 13. When configured in this way, top and bottom sealers 10 are able to be easily separated when they are set to the tag attaching tool. In addition, the latching piece 16 may be a pyramid in place of a cone. Even when the latching piece is formed in the form of a pyramid, the thin part of the head end is connected to the neighboring inserting head section 13. Even when configured in this way, the direction is not deviated because the inserting head section 13 is connected with the bar 11 at two places of the latching piece 16.

Figure 5:
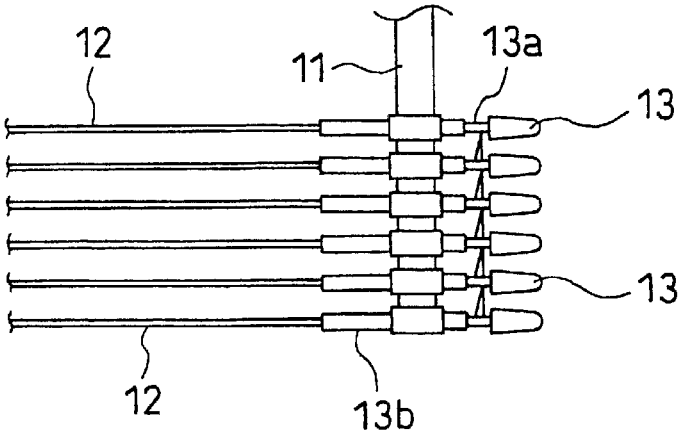
FIG. 5 is an enlarged side view showing an essential part of the other embodiment of the sealer.

For still another embodiment shown in FIG. 5, the latching piece 16 connecting single sealers 10 one another may be disposed at the head end side of the inserting head section 13. Even when configured in this way, the direction is not deviated because the inserting head section 13 is connected with the bar 11 at two places of the latching piece 16.

Figure 11:
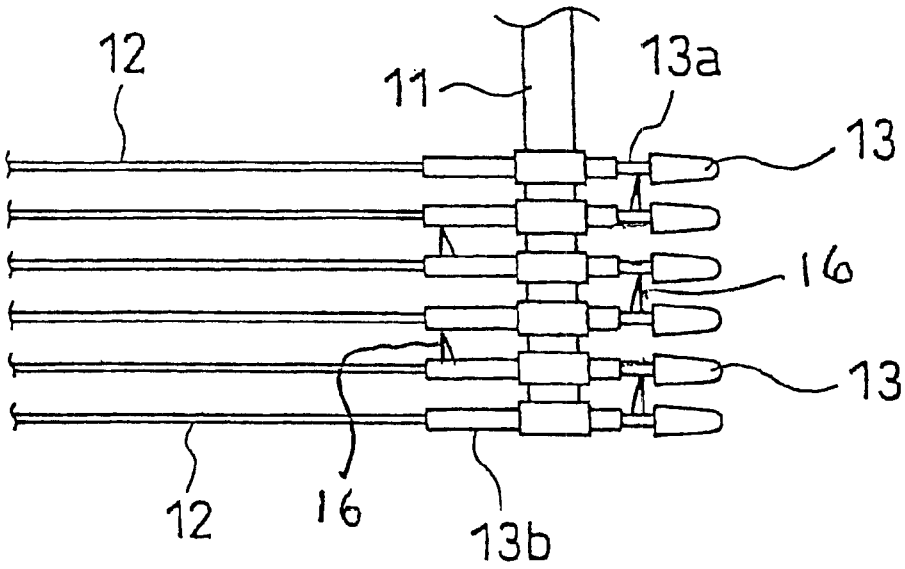
FIG. 11 illustrates an embodiment of the invention with latching pieces on alternate sides of the connecting bar.
Figure 12:
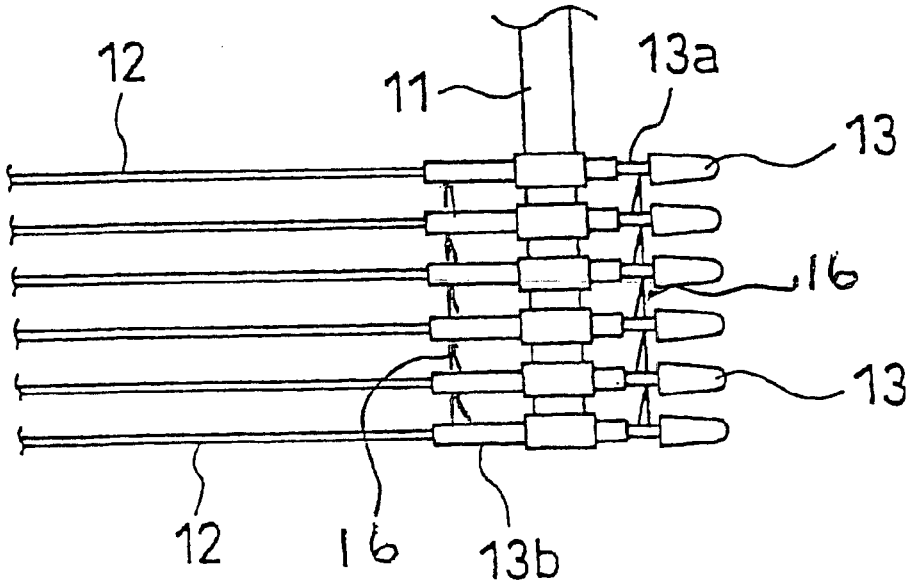
FIG. 12 illustrates an embodiment of the invention with latching pieces on both sides of the connecting bar.

For further embodiment shown in FIG. 11, the latching piece 16 connecting single sealers 10 one another is disposed every other sealer alternately on the head end side of the inserting head section 13 and on the filament section 12 side. Even when the latching piece is formed in the form of a pyramid, the direction is not deviated because the inserting head section 13 is connected with the bar 11 at two places of the latching piece 16. The latching piece 16 may also be on both sides of the connecting bar 11 as shown in FIG. 12.

The filament section used in the sealer related to the present invention may have the cross section in any form of circle, flattened shape, ellipse, or rectangle. In addition, the size of the socket section is preferably visually small enough for enabling easy handling.

EFFECT OF THE INVENTION

Because the present invention adopts the configuration as described above, the directions of inserting head sections do not deviate, respectively, when the sealer is set to the tag attaching tool, or during storage or in transit, and the sealer is able to be smoothly pushed out by the tag attaching pin and generation of jam is able to be prevented.

In addition, when the sealer is used as a single sealer, it is able to be readily operated when labels, etc. are attached to products.

What is claimed is:

1. An array of plural sealers, each of said sealers comprising a filament section with flexibility, an inserting head section with a proper engaging section located at one end of the filament section, and a socket section located at another end of the filament section and equipped with a hole for irreversibly passing the inserting head section, the filament sections of said plural sealers being arranged adjacent to and in parallel to one another with a plurality of the inserting head sections or their neighboring sections and a plurality of said socket sections or their neighboring sections arranged adjacent to one another connected, respectively, to connecting bar sections individually provided, and a portion located in a vicinity of the inserting head sections further connected to one another with latching pieces.

2. The array recited in claim 1 wherein the latching pieces connecting the sealers to each other in the vicinity of the inserting head sections are configured in such a manner to enable easy cutting.

3. The array recited in claim 1 wherein the latching pieces connecting the sealers to each other are disposed on filament section sides of the inserting head sections with respect to one of the connecting bar sections adjacent to the inserting head sections.

4. The array recited in claim 1 wherein the latching pieces connecting the sealers to each other are disposed on engaging section sides of the inserting head sections with respect to one of the connecting bar sections adjacent to the inserting head sections.

5. The array recited in claim 1 wherein the latching pieces connecting the sealers to each other are disposed alternately on engaging section sides and on filament section sides of the inserting head sections with respect to one of the connecting bar sections adjacent to the inserting head sections.

6. The array recited in claim 1 wherein the latching pieces connecting the sealers to each other are disposed on both sides of one of the connecting bar sections adjacent to the inserting head sections.

7. The array recited in claim 1 wherein the latching pieces connecting the sealers to each other are configured to have one end formed in a reduced diameter.

8. The array recited in claim 1 wherein the latching pieces connecting the sealers to each other are cones.

9. The array recited in claim 1 wherein the latching pieces connecting the sealers to each other are pyramids.

* * * * *